US008231294B2

(12) United States Patent
Grossnass et al.

(10) Patent No.: US 8,231,294 B2
(45) Date of Patent: Jul. 31, 2012

(54) MULTI-COSMETIC, EXTENDABLE AND RETRACTABLE COSMETIC APPLICATOR

(76) Inventors: Dov Grossnass, Quebec (CA); Thomas F. Holloway, Southbury, CT (US)

( * ) Notice: Subject to any disclaimer, the term of this patent is extended or adjusted under 35 U.S.C. 154(b) by 569 days.

(21) Appl. No.: 12/397,347

(22) Filed: Mar. 3, 2009

(65) Prior Publication Data

US 2009/0232578 A1 Sep. 17, 2009

Related U.S. Application Data

(60) Provisional application No. 61/033,261, filed on Mar. 3, 2008.

(51) Int. Cl.
*B43K 27/00* (2006.01)

(52) U.S. Cl. ..... 401/32; 401/30; 401/17

(58) Field of Classification Search ..... 401/17, 401/29–30, 32–33, 102, 36
See application file for complete search history.

(56) References Cited

U.S. PATENT DOCUMENTS

| | | | | |
|---|---|---|---|---|
| 1,153,055 | A | 9/1915 | Fuller | |
| 1,623,509 | A | 4/1927 | Vivaudou | |
| 2,029,731 | A * | 2/1936 | Maurer | 401/83 |
| 2,142,312 | A | 1/1939 | Heinz | |
| 3,001,531 | A | 9/1961 | Gazdik | |
| 3,320,962 | A | 5/1967 | Moriber et al. | |
| 4,562,923 | A | 1/1986 | Katada et al. | |
| 4,666,043 | A | 5/1987 | Tahara | |
| 4,692,046 | A * | 9/1987 | Lan | 401/32 |
| 5,026,190 | A * | 6/1991 | Longarzo | 401/30 |
| 5,109,877 | A | 5/1992 | Takeda | |
| 5,301,808 | A | 4/1994 | Pierson | |
| 5,715,848 | A | 2/1998 | Conley, Jr. | |
| 5,927,881 | A * | 7/1999 | Yang | 401/29 |
| 6,540,422 | B2 * | 4/2003 | Torii | 401/31 |
| 6,895,628 | B1 | 5/2005 | Anderson | |
| 2006/0216103 | A1 * | 9/2006 | Bielecki et al. | 401/108 |
| 2007/0280772 | A1 * | 12/2007 | Mika | 401/33 |

FOREIGN PATENT DOCUMENTS

| | | |
|---|---|---|
| FR | 2900547 | 11/2007 |
| FR | 2906114 | 3/2008 |
| GB | 2161788 | 1/1986 |

* cited by examiner

*Primary Examiner* — Dinh Q Nguyen
*Assistant Examiner* — Jennifer Gordon
(74) *Attorney, Agent, or Firm* — O'Connell Law Firm

(57) ABSTRACT

A cosmetic applicator for retaining a plurality of cosmetic members for selective extension and retraction with a housing, a revolver chamber rotatably retained within the housing, a plurality of cosmetic members disposed within longitudinal tubes circumferentially spaced relative to the revolver chamber, a slide button retained to slide along a longitudinal channel in the housing, and an end cap for selectively rotating the revolver chamber to induce one of the plurality of cosmetic members to become an active cosmetic member. The end cap can be rotatably retained relative to the housing and drivingly engaged with the revolver chamber with a key and keyhole combination. The housing can have has an eccentric aperture in the distal end thereof and the cosmetic members can be eccentrically disposed relative to the revolver chamber to align selectively with the aperture in the distal end of the housing.

13 Claims, 15 Drawing Sheets

MULTI-COSMETIC, EXTENDABLE AND RETRACTABLE COSMETIC APPLICATOR

This application claims priority to U.S. Provisional Patent Application No. 61/033,261, filed Mar. 3, 2008.

FIELD OF THE INVENTION

The present invention relates generally to cosmetic applicators. More particularly, disclosed herein is a cosmetic applicator for retaining a plurality of cosmetic members in an extendable and retractable manner to enable the application of multiple disparate cosmetics with a single device.

BACKGROUND OF THE INVENTION

Numerous cosmetic applicators have been disclosed by the prior art. Devices have been taught for retaining eye and lip pencil leads, lipstick, and other types of cosmetics in an extendable and retractable manner. Under such constructions, a single cosmetic can be extended from the applicator for usage and then retracted for storage.

The present inventors have appreciated, however, that there are many circumstances where a user will seek to apply or will wish to have access to multiple cosmetics, whether they all be of the same type, such as eye pencils of different shades, or of different types, such as lip pencils, eye pencils, or other cosmetics. To do so using applicators typical of the prior art, the user generally must retain multiple different applicators, which can be cumbersome and awkward. Alternatively, where several individual devices cannot be retained, the user often must forgo access to the multiple cosmetics that might be desired.

Cosmetic applicators retaining multiple cosmetic pencils and other cosmetics have been attempted by the prior art. However, the devices of the prior art have suffered from a number of challenges that have thus far seemed to prevent them from achieving widespread commercial acceptance. For example, many attempts by prior art inventors have resulted in unwieldy and overly complex mechanical structures. Furthermore, prior art applicators have proven difficult to operate and unreliable in function. Retained cosmetics are often subject to complex movements and unacceptable stresses thereby risking damage to the product to be applied.

With a knowledge of these deficiencies of the prior art, it has become clear to the present inventors that there is a need in the art for a cosmetic applicator that is capable of providing access to multiple cosmetics in a single, elegant device that functions smoothly and effectively.

SUMMARY OF THE INVENTION

Based on their knowledge of the needs left by the prior art, the present inventors set about with the basic object of providing a cosmetic applicator capable of retaining multiple cosmetics in a single device that is smooth and reliable in performance and elegant in design and operation.

A further object of embodiments of the invention is to retain multiple volumes of cosmetics in an extendable and retractable manner to enable access to multiple cosmetics while requiring the user to retain only a single article.

Another object of embodiments of the invention is to provide a cosmetic applicator that enables a user to perceive the type, color, and volume of each retained cosmetic to facilitate the selection and application of the same.

Still another object of embodiments of the invention is to provide a cosmetic applicator that retains, extends, and retracts cosmetic members in a protected and minimally stressful manner.

These and further objects and advantages of embodiments of the invention will become obvious not only to one who reviews the present specification and drawings but also to one who has an opportunity to make use of an embodiment of the instant invention for a cosmetic applicator disclosed herein. The accomplishment of each of the foregoing and possibly further objects in a single embodiment of the invention may be possible and indeed preferred. However, it will be appreciated that not all embodiments will seek or need to accomplish each and every potential object and advantage. Nonetheless, all such embodiments should be considered within the scope of the present invention.

In carrying forth the invention, one basic embodiment of the cosmetic applicator is founded on a housing with a proximal end and a distal end. A revolver chamber is rotatably retained within the housing. A plurality of longitudinal tubes slidably retain a plurality of cosmetic members circumferentially spaced relative to the revolver chamber. An end cap can act as a means for selectively rotating the revolver chamber and the housing in relation to one another to induce one of the plurality of cosmetic members to become an active cosmetic member. A slide button is retained to slide along the longitudinal channel in the housing, and a means is provided for drivingly engaging the slide button with the active cosmetic member. With this, the revolver chamber can be selectively rotated to cause a desired cosmetic member from among the plurality of cosmetic members to become the active cosmetic member and whereby the active cosmetic member can be extended and retracted relative to the housing by a sliding of the slide button.

One cosmetic member can be retained relative to each longitudinal tube and a means can be provided for fixing each cosmetic member against rotation relative to the longitudinal tube. In one embodiment, the means for fixing each cosmetic member against rotation relative to the respective longitudinal tube comprises an alignment groove retained relative to one of the cosmetic member and the longitudinal tube in combination with an alignment rib retained relative to the other of the longitudinal tube and the cosmetic member. In particular embodiments, a cap member can be coupled to each cosmetic member, and the alignment groove or the alignment rib can be disposed on the cap member. The slide button can be engaged with the active cosmetic member by, for example, at least one leg that projects from the slide button for being received through the longitudinal channel in the housing in combination with a laterally disposed locking channel fixed in relation to each of the plurality of cosmetic members.

The longitudinal channel can have a plurality of surface deviations therealong, and the at least one leg has a means for engaging the surface deviations along the channel to enable the slide button to be retained at a given position along the longitudinal channel. The end cap can be drivingly engaged with the revolver chamber by a mating engagement between the end cap and the revolver chamber. Furthermore, a concentric hub can project proximally within the housing from adjacent to the distal end thereof and a concentric centering ring can be disposed in the distal end of the revolver chamber whereby the concentric hub and centering ring can be matingly engaged to center the revolver chamber.

The end cap can be retained relative to the proximal end of the housing, and a proximal portion of the end cap can be received into the housing. In such a case, the applicator can further comprise a plurality of centering protuberances that project from a proximal portion of the end cap for centering the proximal portion of the end cap and the proximal end of the revolver chamber in relation to the housing. Each of the plurality of centering protuberances can be retained relative to the end cap by a resilient tab. The housing can have an aperture in the distal end thereof that is eccentric in relation to the center of the housing and the plurality of cosmetic members can be eccentrically disposed relative to the revolver chamber to align selectively with the aperture in the distal end of the housing.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

BRIEF DESCRIPTION OF THE DRAWINGS

The invention may be more completely understood with reference to the accompanying drawings, in which.

DETAILED DESCRIPTION OF PREFERRED EMBODIMENTS

It will be appreciated that the cosmetic applicator disclosed herein is subject to widely varied embodiments. However, to ensure that one skilled in the art will be able to understand and, in appropriate cases, practice the present invention, certain preferred embodiments of the broader invention revealed herein are described below and shown in the accompanying drawing figures. Before any particular embodiment of the invention is explained in detail, it must be made clear that the following details of construction, descriptions of geometry, and illustrations of inventive concepts are mere examples of the many possible manifestations of the invention. It will be further appreciated that, while the present discussion relates primarily to devices for enabling the retention and application of cosmetics, the applicator disclosed herein is not so limited and may find useful application in other industries beyond the field of cosmetics.

Figure 1:
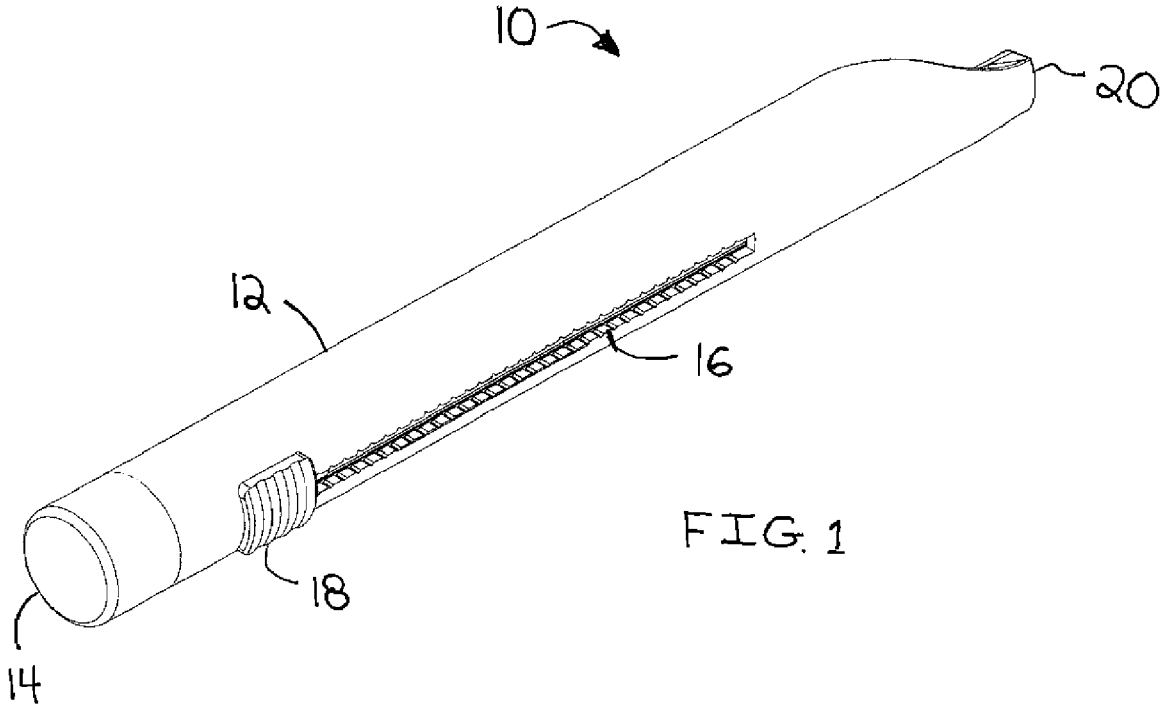
FIG. 1 is a perspective view of a multi-cosmetic, extendable and retractable cosmetic applicator pursuant to the present invention.
Figure 2:
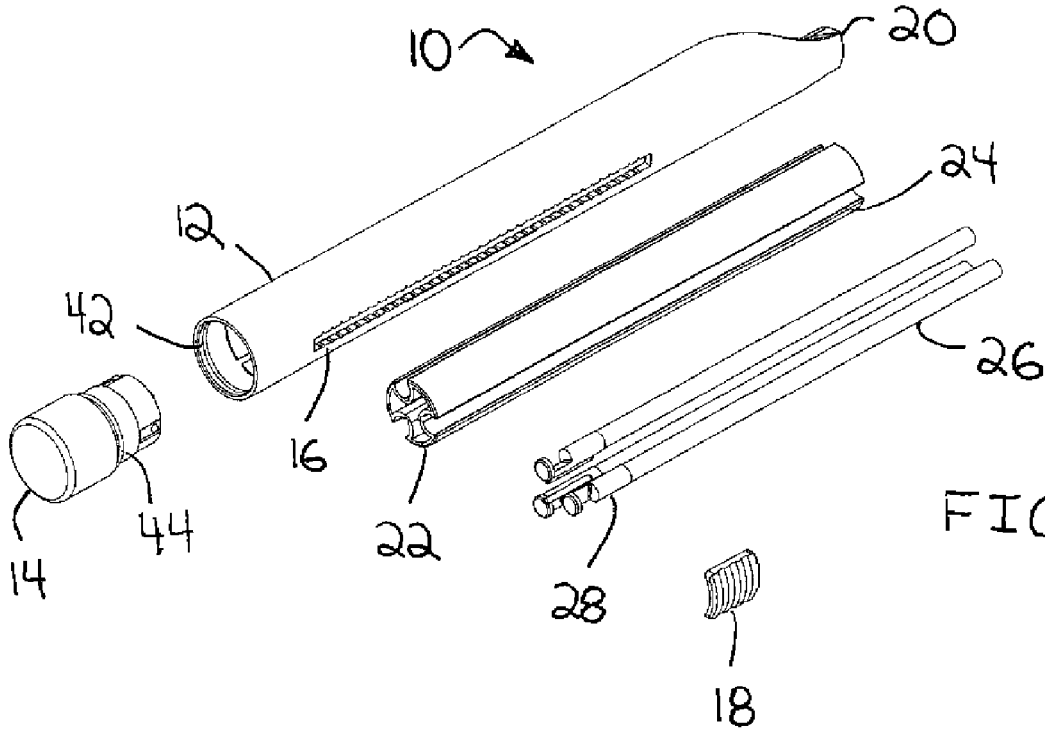
FIG. 2 is an exploded perspective view of the cosmetic applicator of FIG. 1.
Figure 3:
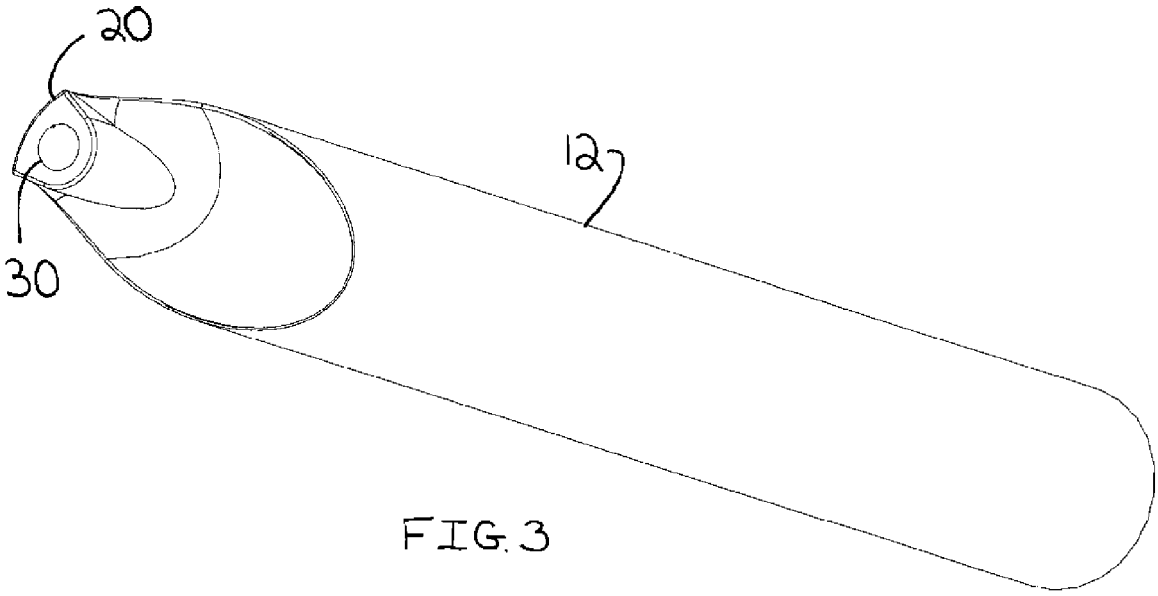
FIG. 3 is a perspective view of a housing pursuant to the instant invention.

Looking more particularly to the drawings, a first cosmetic applicator according to the present invention is indicated generally at 10 in FIG. 1, and the cosmetic applicator 10 is shown in an exploded view in FIG. 2. The cosmetic applicator 10 is founded on a tubular housing 12 having a generally round cross section. As shown in FIG. 3, the tubular housing 12 has a tip portion 20 with an aperture 30 through which a volume of cosmetic can be extended and retracted. An end cap 14 is rotatably engaged with the tubular housing 12 for being selectively rotated to cause a slide button 18 to engage one cosmetic pencil 26 from among a plurality of cosmetic pencils 26 for extension and retraction relative to the housing 12. As described herein, the cosmetic applicator 10 can be considered to have a proximal end formed by the end cap 14 and a distal end formed by the tip portion 20.

In the present embodiment, the end cap 14 is rotatably retained relative to the housing 12 by an annular groove 42 in combination with an annular ridge 44. In the depicted example, the groove 42 is disposed along the inner surface of the housing 12, and the ridge 44 is disposed on the outer surface of the end cap 14. With this, the end cap 14 is rotatably retained relative to the housing 12 by a snap fit between the ridge 44 and the groove 42.

The slide button 18 is slidably retained in a longitudinal channel 16 in the tubular housing 12. As will be described more fully hereinbelow, a rotation of the end cap 14 in relation to the tubular housing 12 will selectively engage the slide button 18 with a desired cosmetic pencil 26. With that, a sliding of the button 18 distally along the channel 16 will induce the selected cosmetic pencil 26 to be extended to have a distal end thereof project through the aperture 30 in the tip portion 20 of the tubular housing 12. The selected cosmetic pencil 26 can be retracted by a sliding of the button 18 proximally along the channel 16.

As shown in FIGS. 5, 6, and 13 through 15, a revolver pencil chamber 22 is rotatably retained within the tubular housing 12. The revolver chamber 22 can retain a plurality of cosmetic pencils 26. In this example, three cosmetic pencils 26 are retained, but it will be appreciated that just two cosmetic pencils 26 or more than three cosmetic pencils 26 could readily be retained within the scope of the invention. The revolver chamber 22 is generally round in cross section with first, second, and third longitudinal pencil tubes 24 disposed therein. The pencil tubes 24 are defined by a wall with a circular cross section.

As shown, the wall can traverse greater than 180 but less than 360 degrees thereby to leave an open outer channel 34 communicating longitudinally along the pencil tube 24. It will therefore be clear that, as the term is used herein, a tube need not form a complete cylinder and may have an open channel 34 therein. Further, except as expressly required, the pencil tubes 24 need not be round. Where the pencil tubes 24 are round, a cosmetic pencil 26 having a diameter preferably slightly less than a diameter of the pencil tube 24 can be slid into each pencil tube 24 as seen, for example, in FIG. 13. The cosmetic pencil 26 is thus retained against radial dislodging by the pencil tube's spanning greater than 180 degrees.

Figure 4:
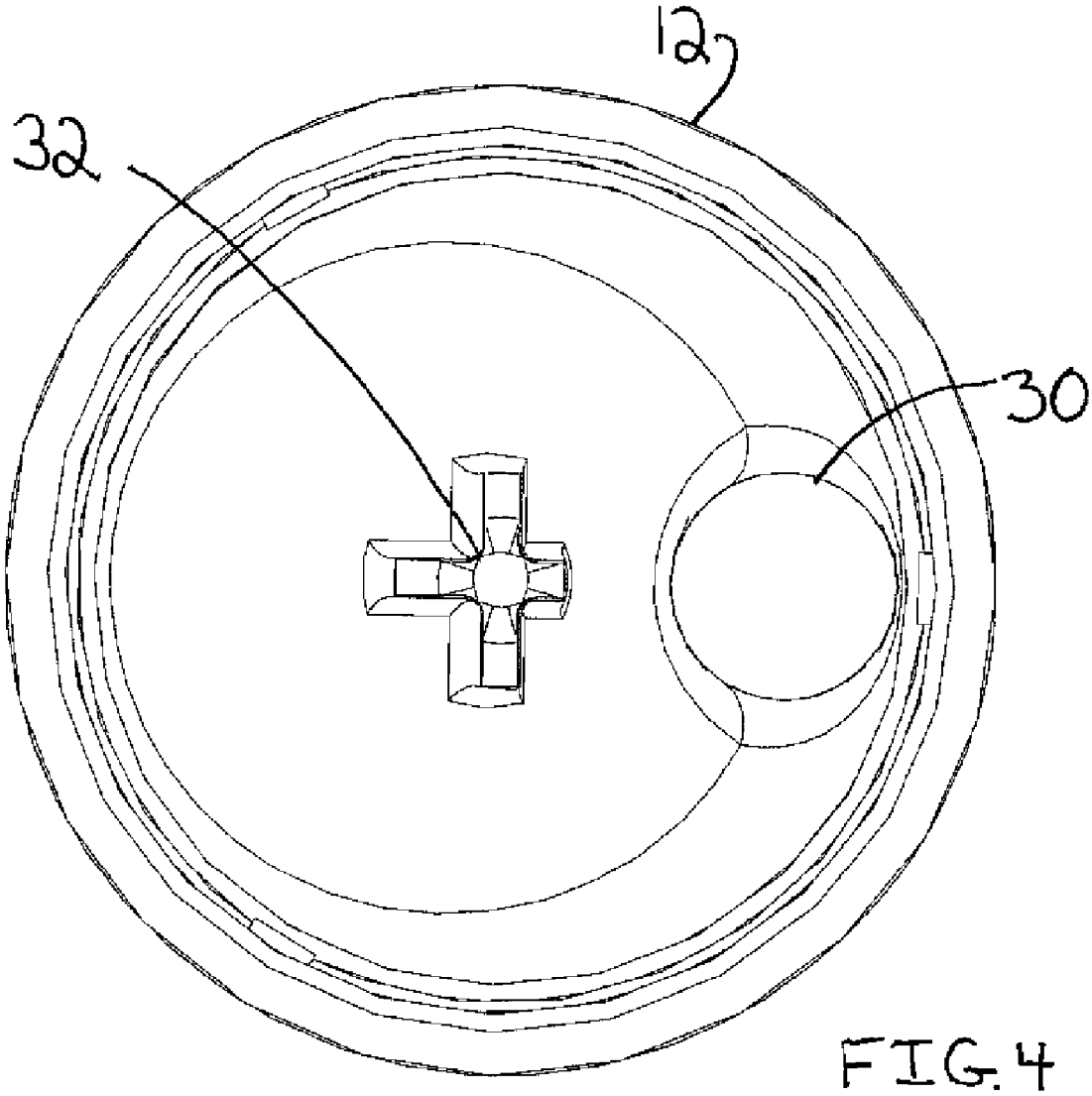
FIG. 4 is a proximal end view of the housing of FIG. 3.
Figure 5:
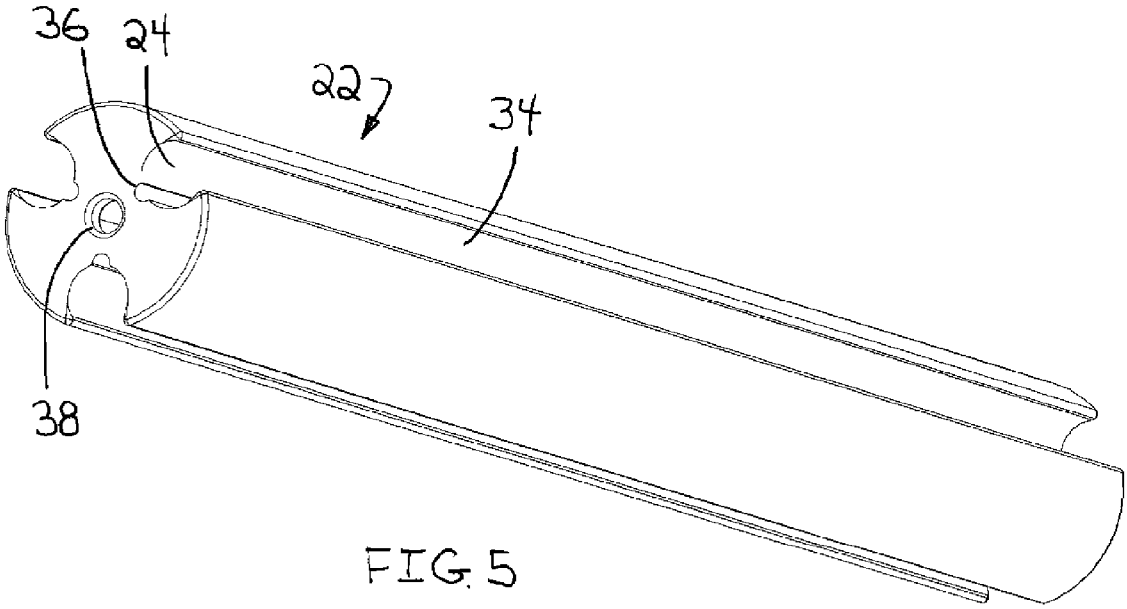
FIG. 5 is a perspective view of a revolver pencil chamber under the invention disclosed herein.

As best appreciated by reference to FIG. 4, the aperture 30 in the distal end of the tubular housing 12 is eccentric in relation to the center of the tubular housing 12. Similarly, with further reference to FIGS. 13 through 15, the pencil tubes 24, and thus the retained pencils 26, are eccentrically disposed within the revolver chamber 22 to align selectively with the aperture 30. Therefore, each cosmetic pencil 26 can be aligned with the aperture 30 with a selective rotation of the revolver chamber 22.

The longitudinal channel 16 and the aperture 30 in the distal portion 20 of the tubular housing 12 can be longitudinally aligned. As a result, a cosmetic pencil 26 aligned with the aperture 30, which would thus be considered the active pencil 26, will be disposed in alignment with the channel 16. With that, one can perceive through the channel 16 which cosmetic pencil 26 is active and aligned for extension and retraction.

The tip portion 20 can be contoured in relation to the generally tubular remainder of the housing 12 to enable the cosmetic applicator 10 to be oriented and controlled for optimal material application. More particularly, the tip portion 20 can have an arcuate narrowing toward the distal end of the housing 12 until the tip portion 20 reaches a generally round end in concentric alignment with the aperture 30.

Each pencil tube 24 has a registration or alignment groove 36 therein that traverses longitudinally from the proximal end to the distal end of the revolver chamber 22. Further, each cosmetic pencil 26 has a registration or alignment projection, in this case an alignment rib 62, that is fixed to project radially in relation to the cosmetic pencil 26. With this, the orientation of each cosmetic pencil 26 can be fixed in relation to the pencil tube 24 and the cosmetic applicator 10 in general by a slidable reception of the alignment rib 62 into the alignment groove 36 as shown, for example, in FIGS. 13 through 15. In this example, the alignment groove 36 and the alignment rib 62 are disposed along a radius from the centerline of the revolver chamber 22, but such need not be the case.

Figure 9:
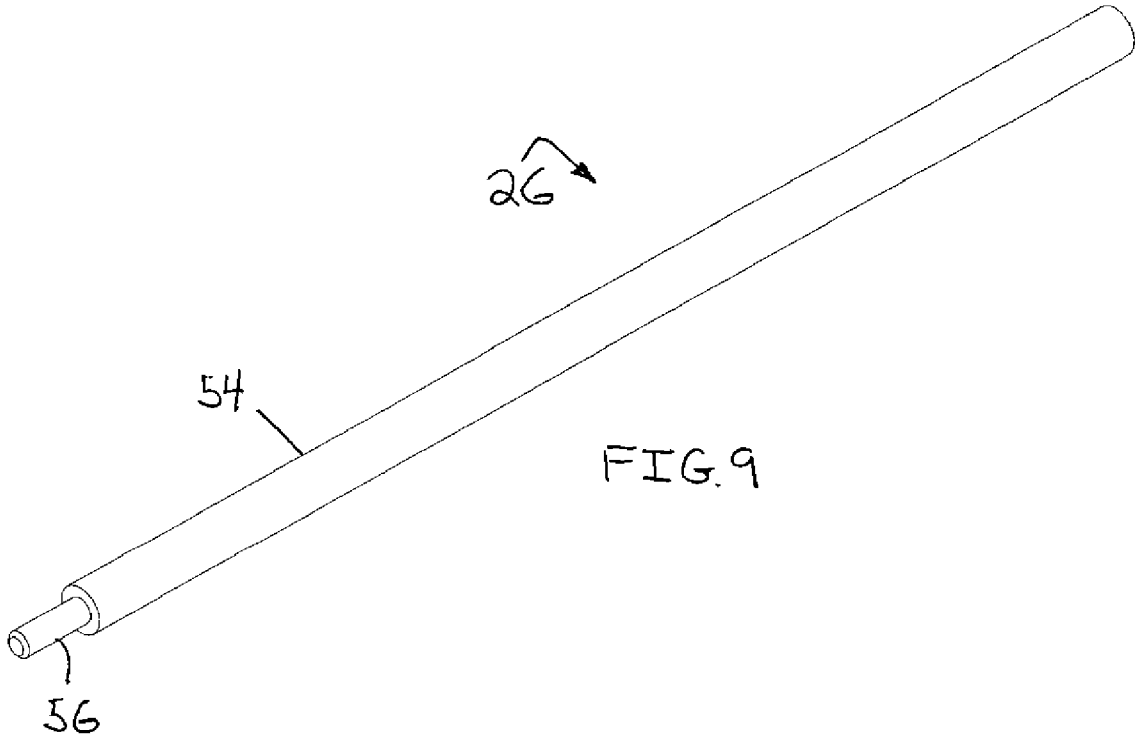
FIG. 9 is a perspective view of a pencil pursuant to the invention.
Figure 10:
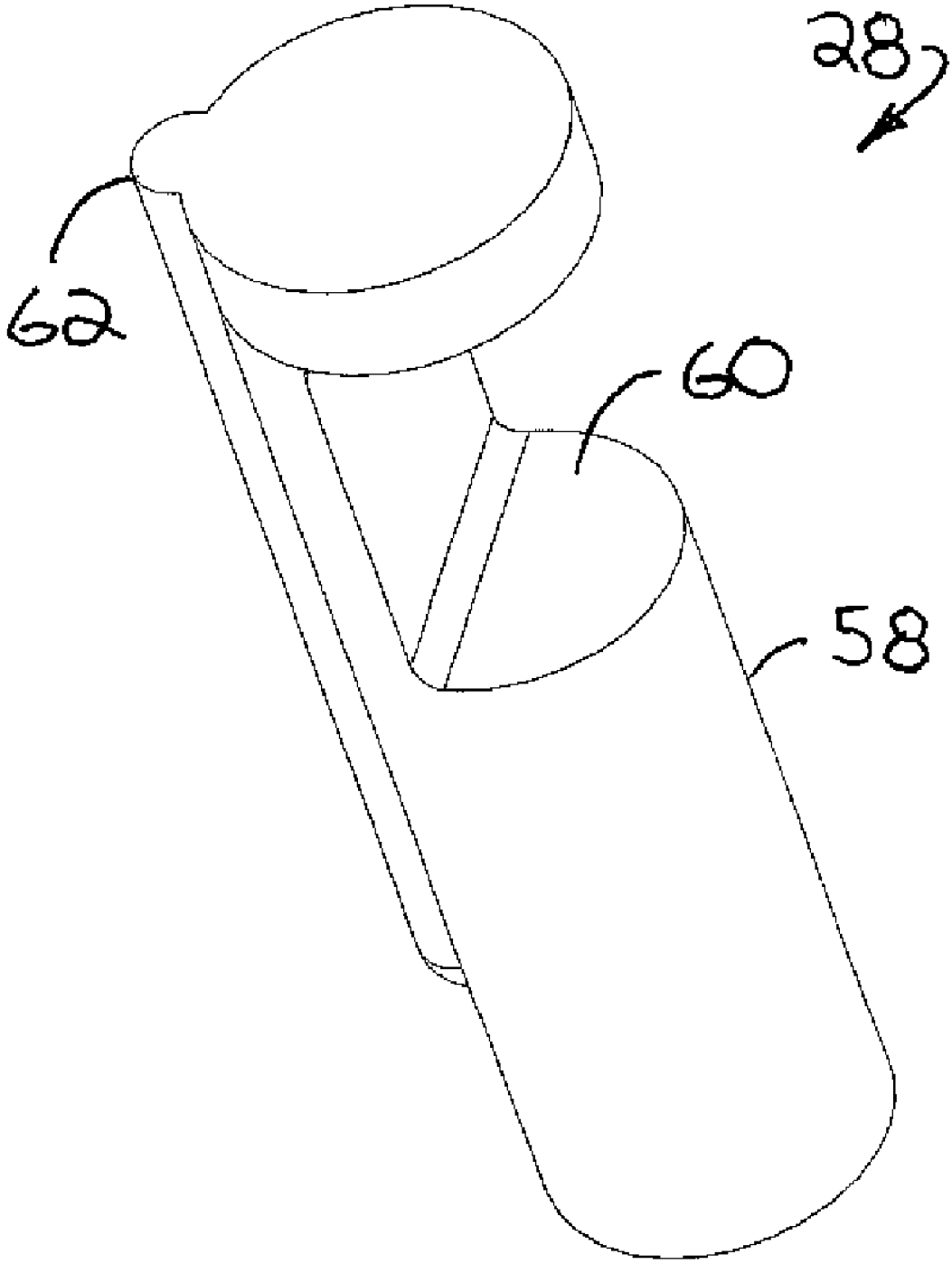
FIG. 10 is a forward perspective view of a pencil cup for use with the pencil of FIG. 9.
Figure 11:
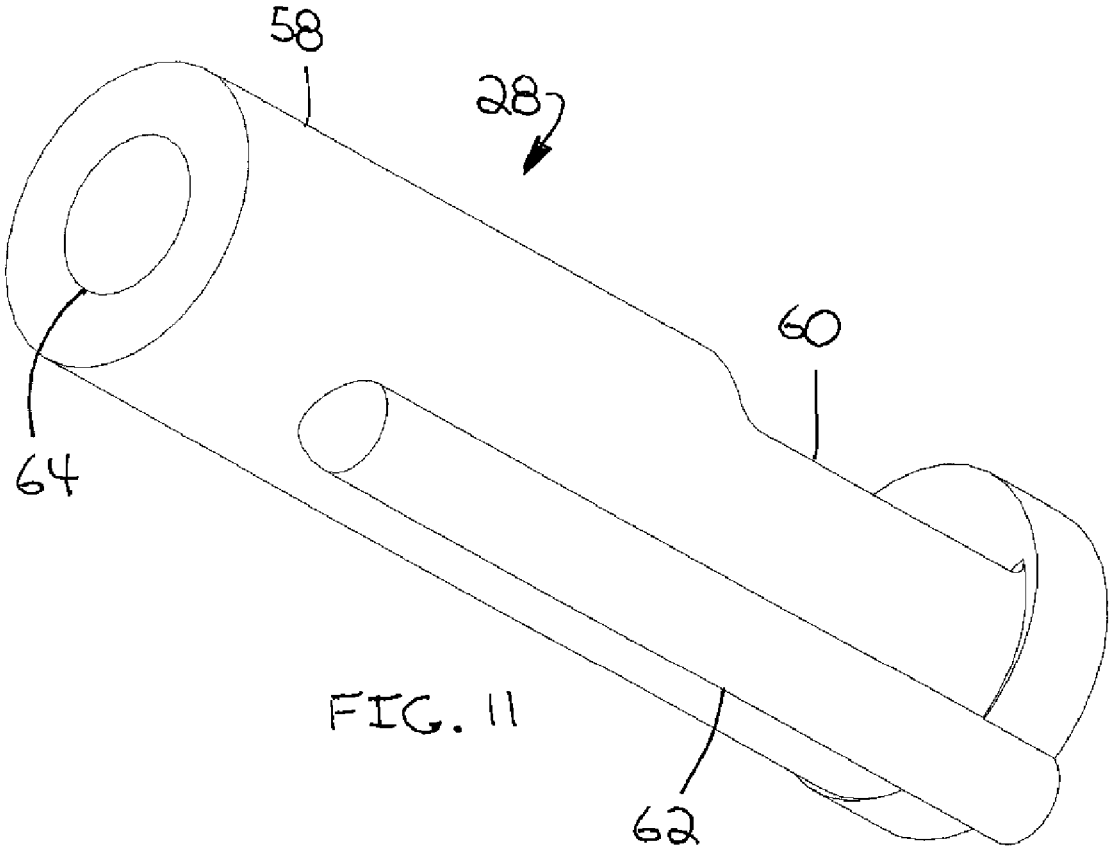
FIG. 11 is a rearward perspective view of the pencil cup of FIG. 10.
Figure 12:
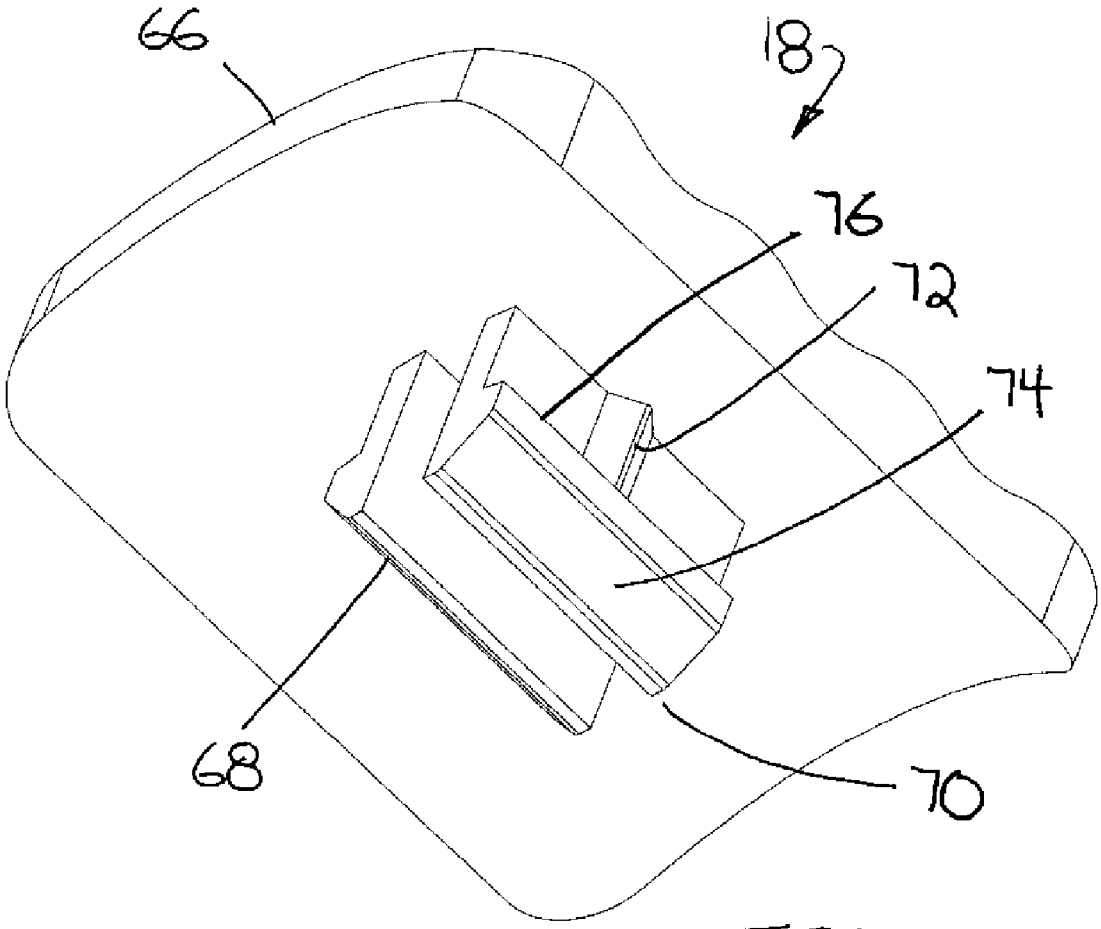
FIG. 12 is a perspective view of a push button.
Figure 13:
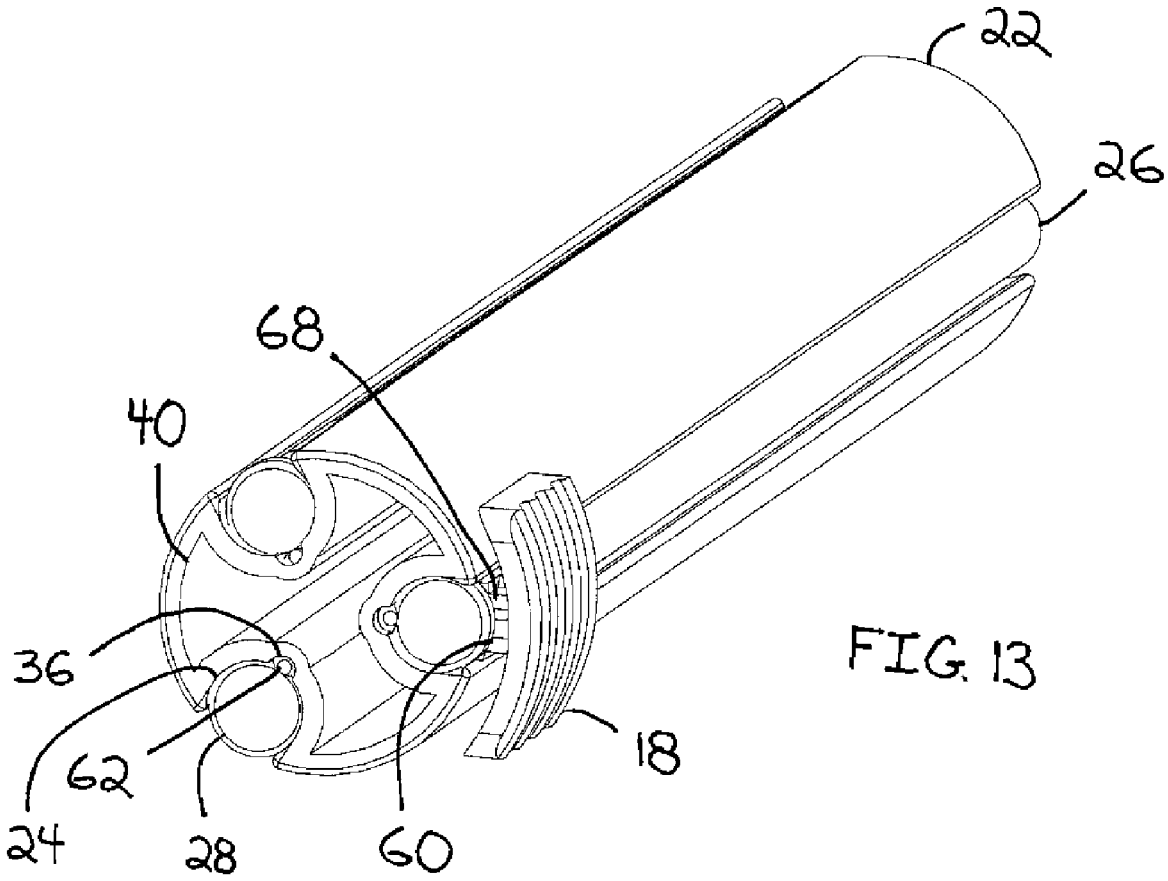
FIG. 13 is a perspective view of the revolver chamber retaining a plurality of cosmetic pencils.
Figure 14:
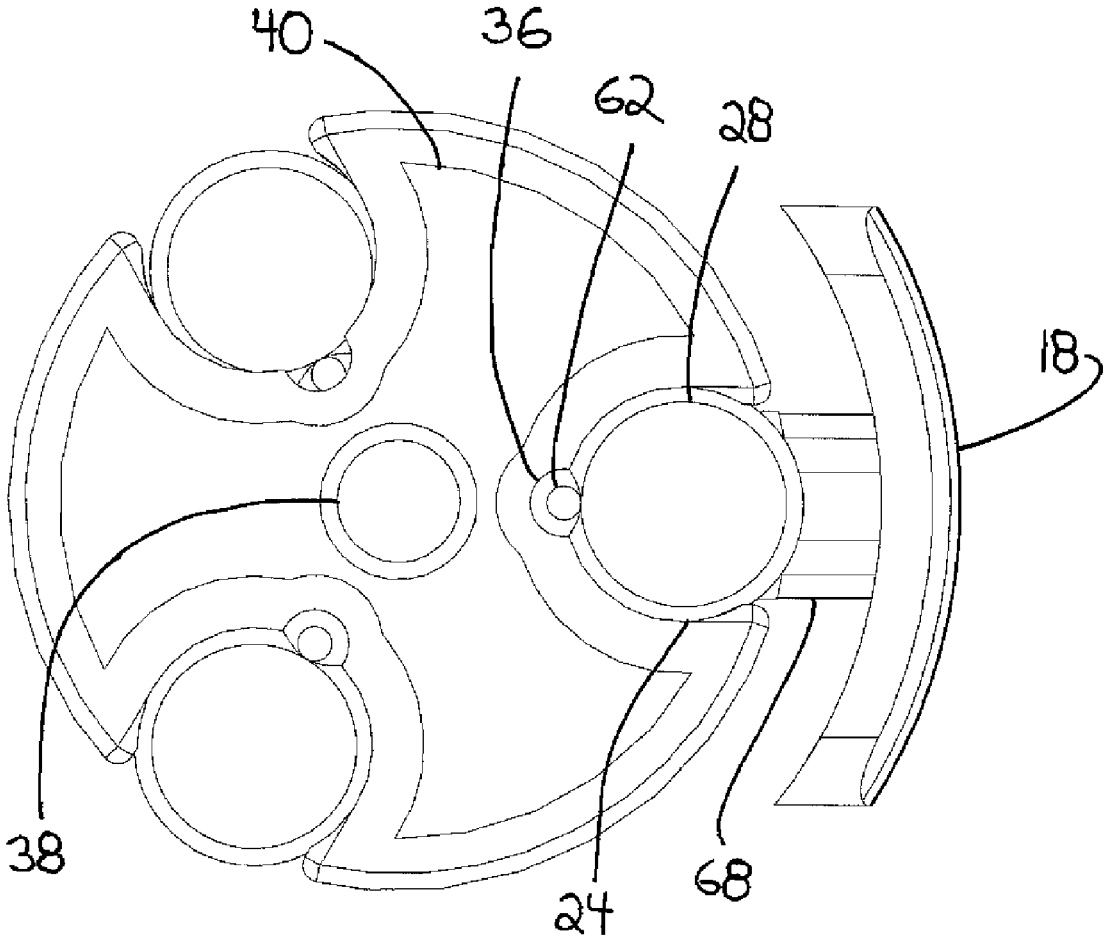
FIG. 14 is a proximal end view of the revolving chamber retaining a plurality of cosmetic pencils.

It is possible for the alignment projection to be integrally formed with or embedded in the body portion 54 of the substrate forming the cosmetic pencil 26. In the current embodiment, however, the alignment rib 62 projects from a pencil cap 28 that is fixed to the cosmetic pencil 26 as shown in FIG. 2. While the coupling of the pencil 26 with the pencil cap 28 could be accomplished in many ways within the scope of the invention, the pencil 26 in the present embodiment has a proximal end rod 56 as shown in FIG. 9 that is matingly received into a distal borehole 64 in the pencil cap 28, which is seen in FIG. 11. The pencil cap 28 can have a round body portion 58 with a diameter approximately equal to the diameter of the body portion 54 of the cosmetic pencil 26 such that the coupled pencil 26 and pencil cap 28 join to form a smooth and continuous structure.

Figure 15:
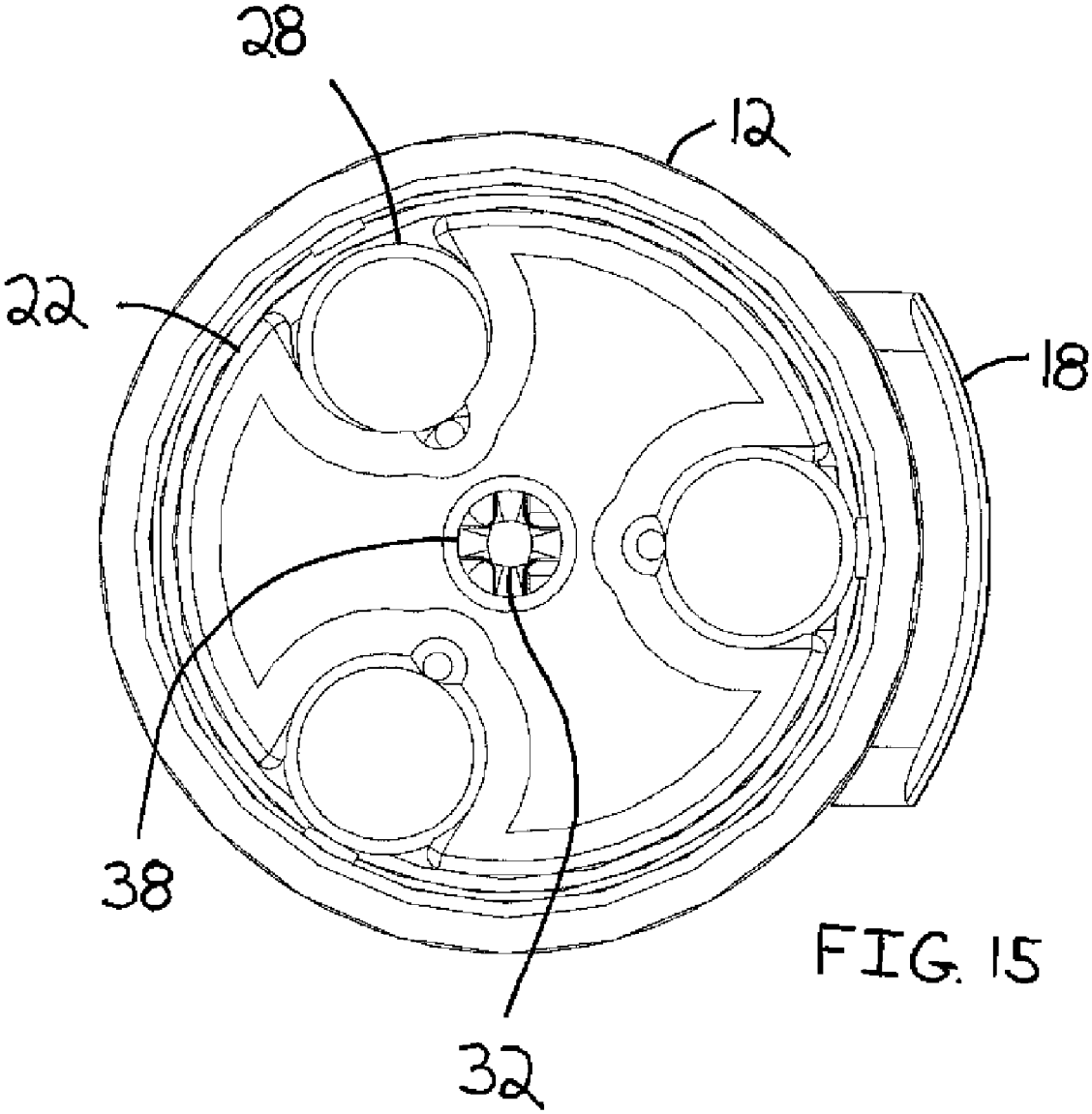
FIG. 15 is a proximal end view of the revolving chamber retaining a plurality of cosmetic pencils as disposed in the tubular housing.

As shown in FIG. 4, the tubular housing 12 has a concentric hub 32 that projects proximally within the tubular housing 12 from adjacent to the distal end thereof. The revolver chamber 22 has a corresponding concentric centering ring 38 disposed at the distal end thereof. With this, the hub 32 can be received into the centering ring 38 as seen in FIG. 15 to serve as an axle. The hub 32 and ring 38 thereby maintain a substantially concentric relationship between the distal ends of the revolver chamber 22 and the tubular housing 12 and facilitate a smooth rotation of the revolver chamber 22 in relation to the tubular housing 12.

The end cap 14 is positively engaged with the revolver chamber 22 such that rotation of the revolver chamber 22 can be achieved by a rotation of the end cap 14, which can have a grip portion 46. Consequently, a selective alignment of a desired cosmetic pencil 26 with the longitudinal channel 16, the slide button 18, and the aperture 30 can be accomplished by a selective rotation of the end cap 14 to yield a corresponding rotation of the revolver chamber 22.

Figure 6:
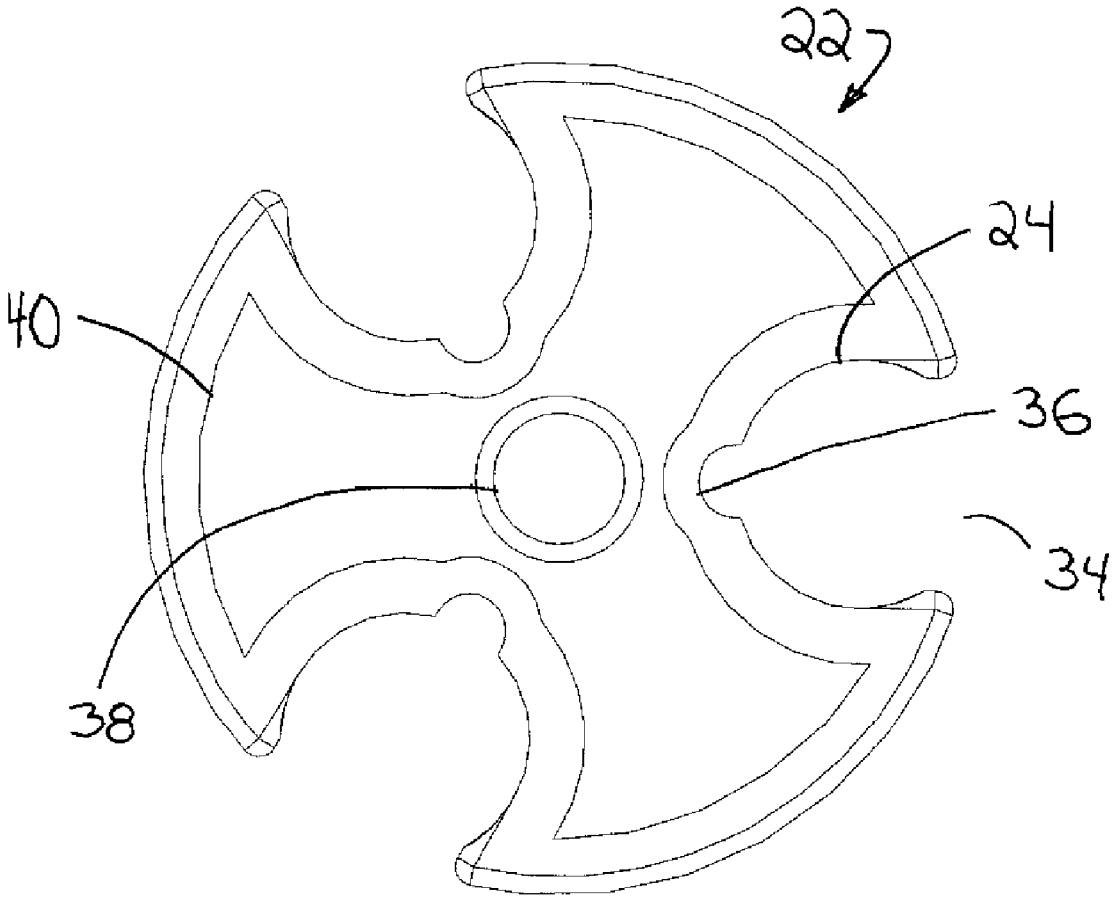
FIG. 6 is a proximal end view of the revolver chamber of FIG. 5.

Positive, driving engagement between the end cap 14 and the revolver chamber 22 can be accomplished in any effective manner. Indeed, the end cap 14 and the revolver chamber 22 could be integrally formed or fastened together by adhesive, welding, or any other method. In the presently contemplated embodiment, however, positive engagement is achieved by a mating engagement or key-keyhole relationship. More particularly, as seen in FIG. 6, a keyhole 40 can be formed in the proximal portion of the revolver chamber 22 and a key 48 can project distally from the end cap 14.

The key 48 and keyhole 40 can be correspondingly shaped and sized so that the key 48 can positively engage the keyhole 40, such as by being received therein. Of course, substantially any non-round, complementary shape would be possible. The depicted embodiment, by way of example, has a concentric three-legged key 48 for engaging a concentric three-legged keyhole 48. While the key 48 is shown relative to the end cap 14 and the keyhole 40 is shown disposed relative to the revolver chamber 22, it will be clear that the two could readily be oppositely disposed.

Figure 7:
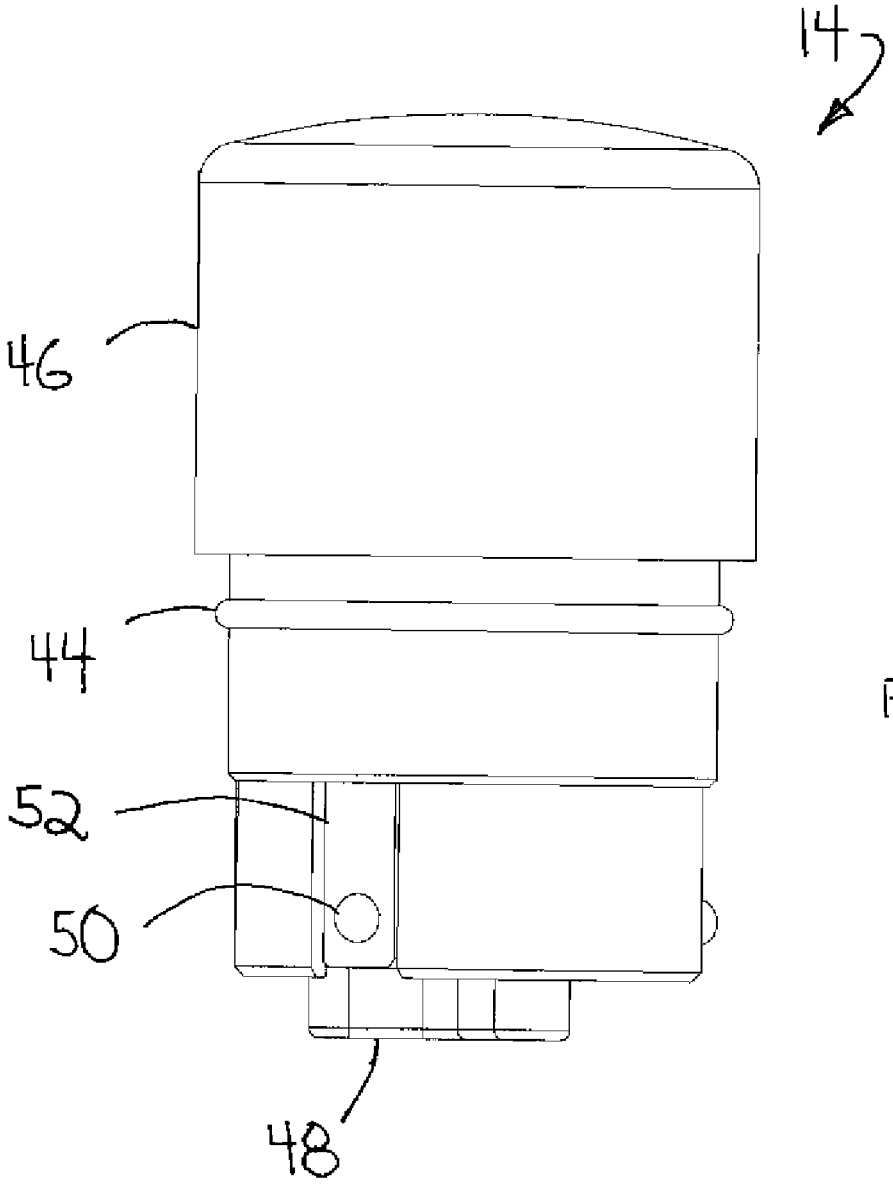
FIG. 7 is a view in front elevation of an end cap according to the invention.
Figure 8:
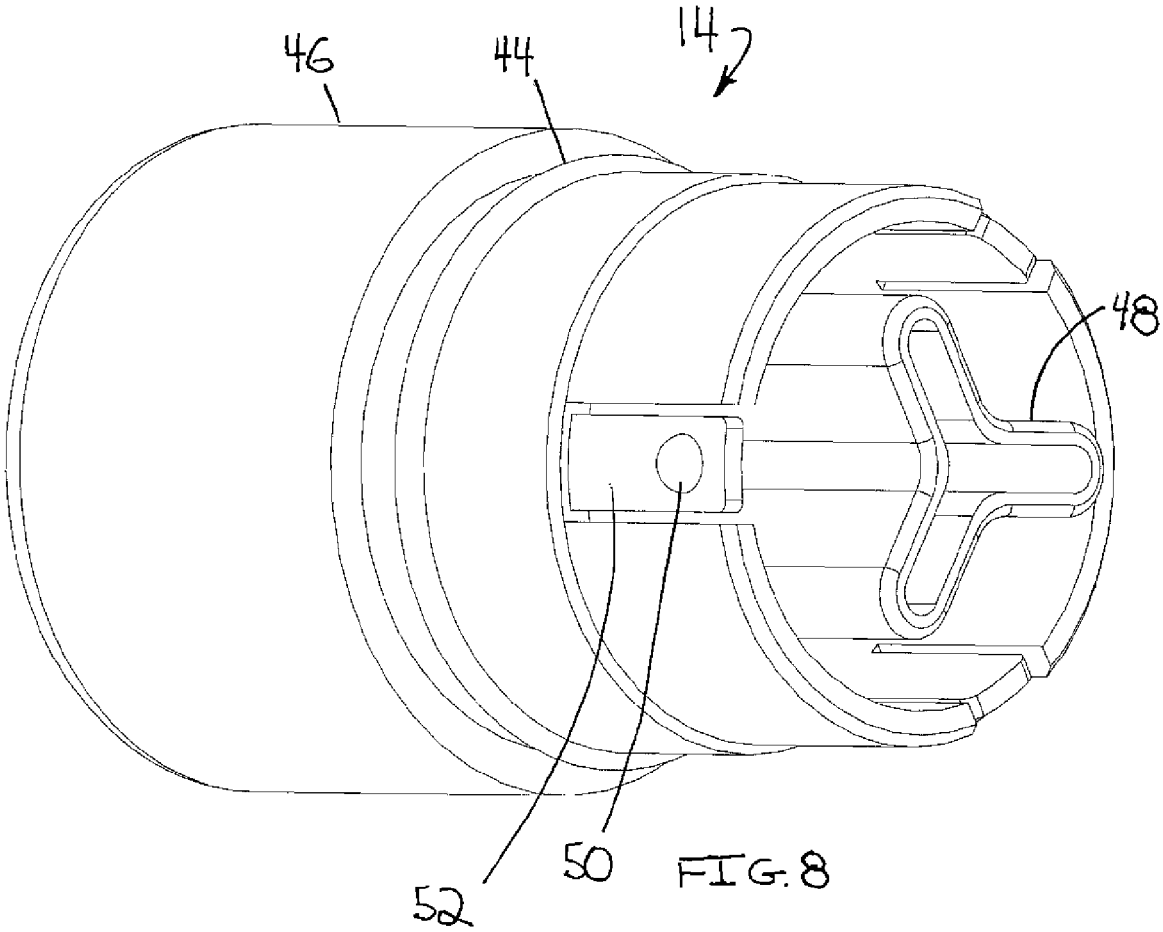
FIG. 8 is a perspective view of the end cap of FIG. 7.

By further reference to FIGS. 7 and 8, one can perceive that the end cap 14 provides a means for centering the distal portion thereof in relation to the tubular housing 12. In turn, the centering of the distal portion of the end cap 14 yields a centering of the proximal portion of the revolver chamber 22. Still further, the centering of the proximal portion of the revolver chamber 22 will tend to maintain alignment between the active cosmetic pencil 26, the longitudinal channel 16, and the slide button 18.

While a number of means for centering the distal portion of the end cap 14 relative to the tubular housing 12 would be possible, the present embodiment provides a plurality of centering protuberances 50 projecting radially from the end cap 14. Each centering protuberance 50 is retained on a resilient tab 52. The centering protuberances 50 can establish an effective circumference equal to or marginally greater than the inner circumference of the adjacent portion of the tubular housing 12. With that, the resilient tabs 52 can deflect to accommodate the tubular housing 12 and to produce a slidable, frictional engagement between the end cap 14 and the tubular housing 12. A relative centering can thus be achieved.

When a selected cosmetic pencil 26 is aligned with the slide button 18, the slide button 18 can be drivingly engaged with the selected pencil 26 by any means for positively engaging the slide button 18 with the cosmetic pencil 26. A number of such means might be obvious after reading the present disclosure and viewing the accompanying drawings. Each is within the scope of the invention except as it might be expressly limited.

One presently contemplated means can be understood by combined reference to FIGS. 10 through 13. There, the pencil cap 28 has a locking channel 60 that communicates laterally across the outwardly facing portion of the pencil cap 28 such that it has opposed proximal and distal faces and an inner, longitudinally communicating face. The slide button 18 has first and second opposed legs 68 and 70 with each leg having an outwardly facing bevel 74 at the distal end thereof, an outwardly facing shoulder 76 proximal to the bevel, and a ridge 72 proximal to the shoulder 76.

Under this arrangement, the slide button 18 can be retained relative to the longitudinal channel 16 by snapping the distal portions of the opposed legs 68 and 70 through the channel 16. Where a pencil cap 28 and thus a cosmetic pencil 26 is aligned with the longitudinal channel 16 and thus the slide button 18, the legs 68 and 70 of the slide button will be received into the locking channel 60 between the proximal and distal faces of the locking channel 60. With that, the slide button 18 and the cosmetic pencil 26 are effectively coupled such that a longitudinal sliding of the button 18 will yield a longitudinal sliding of the cosmetic pencil 26. Where the outer edges of the shoulders 76 on the legs 68 and 70 are separated by more than the narrowest width of the channel 16, the shoulders 76 prevent the slide button 18 from dislodging while allowing it to slide along the channel 16.

As shown in FIGS. 1 and 2, the channel 16 can have a plurality of ridges, troughs, notches, or other surface deviations therealong, and the opposed ridges 72 on the legs 68 and 70 can be sized to interfere with the opposed ridges along the channel 16. With this, the slide button 18 and, thus a cosmetic pencil 26 controlled thereby, can be selectively retained at a given position to prevent inadvertent retraction of the cosmetic pencil 26 during usage.

When a different cosmetic pencil 26 is desired, the user can rotate the end cap 14 thereby to rotate the revolver chamber 22. The outwardly facing bevel 74 of the respective leg 68 or 70 of the slide button 18 will allow it to slide over the edge of the pencil tube 24 and retract from the locking channel 60. The distal tips of the legs 68 and 70 can then slide over the periphery of the revolver chamber 22 until the next cosmetic pencil 26 is reached whereupon the legs 68 and 70 can be received into the locking channel 60 of that cosmetic pencil 26. With this, the user can readily select the active cosmetic pencil 26 from among the plurality of retained cosmetic pencils 26 by a simple rotation of the end cap 14. The selected cosmetic pencil 26 can be extended for usage by a sliding of the slide button 18 distally and retracted for storage by a sliding of the slide button 18 proximally.

It will thus be clear that the cosmetic applicator 10 disclosed herein can be used for retaining and applying multiple members of a wide variety of cosmetic materials, including, by way of example and not limitation, lip pencil leads, eye pencil leads, lipstick, mascara, and substantially any other cosmetic material that might be desired. The cosmetic applicator 10 can retain multiple cosmetic members, such as pencils 26, of the same type whereby cosmetic members differing in color, finish, or hardness can be retained. Alternatively, multiple identical cosmetic members can be retained to enable the cosmetic applicator 10 to have a longer effective lifespan. Furthermore, embodiments of the cosmetic applicator 10 can retain multiple different types of cosmetic to enable the application of different cosmetics using a single applicator 10. It should also be noted again that, although the cosmetic applicator 10 has been disclosed primarily as retaining three cosmetic pencils 26, devices within the scope of the present invention could readily be crafted for retaining fewer or additional cosmetic members.

With certain details of the present invention for a cosmetic applicator disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventors. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

We claim as deserving the protection of Letters Patent:

1. A cosmetic applicator for retaining a plurality of cosmetic members for selective extension and retraction, the cosmetic applicator comprising:

a housing with a proximal end and a distal end;

a revolver chamber rotatably retained within the housing wherein the revolver chamber has a proximal end and a distal end;

a plurality of circumferentially spaced longitudinal tubes disposed in the revolver chamber for slidably retaining a plurality of cosmetic members circumferentially spaced relative to the revolver chamber;

a cosmetic member retained within each longitudinal tube in the revolver chamber wherein each cosmetic member has a proximal end and a distal end;

a cap member coupled to the proximal end of each cosmetic member;

a longitudinal channel disposed along the housing;

a slide button retained to slide along the longitudinal channel in the housing;

means for selectively rotating the revolver chamber and the housing in relation to one another to induce one of the plurality of cosmetic members to become an active cosmetic member; and means for drivingly engaging the slide button with the active cosmetic member comprising at least one leg that projects from the slide button for being received through the longitudinal channel in the housing in combination with a laterally disposed locking channel disposed in the cap member that receives the leg that projects from the slide button;

whereby the revolver chamber can be selectively rotated to cause a desired cosmetic member from among the plurality of cosmetic members to become the active cosmetic member and whereby the active cosmetic member can be extended and retracted relative to the housing by a sliding of the slide button.

2. The cosmetic applicator of claim 1 wherein each tube has an open outer channel.

3. The cosmetic applicator of claim 1 further comprising a means for fixing each cosmetic member against rotation relative to the longitudinal tube.

4. The cosmetic applicator of claim 3 wherein the means for fixing each cosmetic member against rotation relative to the respective longitudinal tube comprises an alignment groove retained relative to one of the cosmetic member and the longitudinal tube in combination with an alignment rib retained relative to the other of the longitudinal tube and the cosmetic member.

5. The cosmetic applicator of claim 4 wherein the alignment groove or the alignment rib is disposed on the cap member.

6. The cosmetic applicator of claim 1 wherein the at least one leg that projects from the slide button has opposed, outwardly facing sloped surfaces.

7. The cosmetic applicator of claim 1 wherein the longitudinal channel disposed along the housing has a plurality of surface deviations therealong and wherein the at least one leg has a means for engaging the surface deviations along the longitudinal channel to enable the slide button to be retained at a given position along the longitudinal channel.

8. The cosmetic applicator of claim 1 wherein the means for selectively rotating the revolver chamber comprises an end cap rotatably retained relative to the housing and drivingly engaged with the revolver chamber.

9. The cosmetic applicator of claim 8 wherein the end cap is drivingly engaged with the revolver chamber by a mating engagement between the end cap and the revolver chamber.

10. The cosmetic applicator of claim 8 further comprising a concentric hub that projects proximally within the housing from adjacent to the distal end thereof and a concentric centering ring in the distal end of the revolver chamber whereby the concentric hub and centering ring can be matingly engaged.

11. The cosmetic applicator of claim 8 wherein the end cap is retained relative to the proximal end of the housing and wherein a portion of the end cap is received into the housing and further comprising a plurality of centering protuberances that project from a portion of the end cap for centering the portion of the end cap and the proximal end of the revolver chamber in relation to the housing.

12. The cosmetic applicator of claim 11 wherein each of the plurality of centering protuberances is retained relative to the end cap by a resilient tab.

13. The cosmetic applicator of claim 1 wherein the housing has an aperture in the distal end thereof that is eccentric in relation to the center of the housing and wherein the means for slidably retaining the plurality of cosmetic members comprises a means for retaining the cosmetic members eccentrically disposed relative to the revolver chamber to align selectively with the aperture in the distal end of the housing.

* * * * *